US010641494B2

(12) United States Patent
Cadima

(10) Patent No.: US 10,641,494 B2
(45) **Date of Patent: *May 5, 2020**

(54) COOKTOP APPLIANCE WITH A GAS BURNER ASSEMBLY

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 676 days.

This patent is subject to a terminal disclaimer.

(21) Appl. No.: 15/358,181

(22) Filed: Nov. 22, 2016

(65) Prior Publication Data

US 2018/0142897 A1 May 24, 2018

(51) Int. Cl.
*F24C 3/08* (2006.01)

(52) U.S. Cl.
CPC .... *F24C 3/085* (2013.01); *F23D 2900/14062* (2013.01)

(58) Field of Classification Search
CPC ..... F24C 3/085; F24C 3/082
See application file for complete search history.

(56) References Cited

U.S. PATENT DOCUMENTS 5,405,263 A * 4/1995 Gerdes ..... F23D 14/065 126/39 E
5,623,917 A * 4/1997 Dinaso ..... F23D 14/06 126/39 H
5,690,483 A * 11/1997 Oda ..... F23D 14/06 431/266
7,967,004 B2 * 6/2011 Inzaghi ..... F23D 14/045 126/214 C
8,033,279 B2 * 10/2011 Shaffer ..... F24C 3/126 126/1 R
2006/0207588 A1 9/2006 Staebler
2009/0101132 A1 * 4/2009 Inzaghi ..... F23D 14/045 126/39 R
2010/0005976 A1 * 1/2010 Inzaghi ..... F23D 14/06 99/444
2010/0089384 A1 * 4/2010 Inzaghi ..... F23D 14/06 126/39 E
2010/0126495 A1 * 5/2010 Shaffer ..... F24C 3/126 126/39 E
2010/0200565 A1 * 8/2010 Leung ..... H05B 3/68 219/443.1
2014/0246009 A1 9/2014 Tisselli et al.

FOREIGN PATENT DOCUMENTS

WO WO2013017986 A2 2/2013

* cited by examiner

*Primary Examiner* — Avinash A Savani
*Assistant Examiner* — Deepak A Deean
(74) *Attorney, Agent, or Firm* — Dority & Manning, P.A.

(57) ABSTRACT

A cooktop appliance includes a top panel and a gas burner assembly with a support member formed integrally with a cap at a first end portion of the support member. The support member defines a fuel supply passage that extends between first and second end portions of the support member. A burner body is mounted to the cap such that the burner body is positioned above and spaced from the top panel.

20 Claims, 9 Drawing Sheets

COOKTOP APPLIANCE WITH A GAS BURNER ASSEMBLY

FIELD OF THE INVENTION

The present subject matter relates generally to cooktop appliances and gas burner assemblies for cooktop appliances.

BACKGROUND OF THE INVENTION

Generally, gas cooktop appliances include a plurality of gas burners mounted to a top surface of the appliance. During use of the cooktop, spills and overflows can lead to food particles accumulating on the top surface of the cooktop. Such food particles can collect beneath the gas burners and be difficult to clean.

Oven appliance users frequently cite difficulty cleaning beneath the gas burners as a complaint about modern cooktops. However, cleaning below gas burners on modern cooktops is difficult for a variety of reasons. For example, gas burners that are fastened to the cooktops generally include cracks at assembly interfaces that tend to accumulate food particles. As another example, gas burners that are removable from the cooktops by a user of the cooktop for cleaning generally include holes, supporting geometry and fasteners that are difficult to clean around. In addition, gas burners positioned coincident to top surfaces of associated cooktops inherently heat the top surfaces of the cooktops. The hot top surface of the cooktop can burn food particles, and burnt food particles on the cooktop can be particularly difficult to clean.

Accordingly, a cooktop appliance with features for facilitating cleaning below a burner of the cooktop appliance would be useful. In addition, a cooktop appliance with features for limiting heat transfer from a burner of the cooktop appliance to a top panel of the cooktop appliance would be useful.

BRIEF DESCRIPTION OF THE INVENTION

The present subject matter provides a cooktop appliance. The cooktop appliance includes a top panel and a gas burner assembly with a support member formed integrally with a cap at a first end portion of the support member. The support member defines a fuel supply passage that extends between first and second end portions of the support member. A burner body is mounted to the cap such that the burner body is positioned above and spaced from the top panel. Additional aspects and advantages of the invention will be set forth in part in the following description, or may be apparent from the description, or may be learned through practice of the invention.

In a first exemplary embodiment, a cooktop appliance is provided. The cooktop appliance includes a top panel. A gas burner assembly includes a cap. A support member extends between a first end portion and a second end portion. The support member is formed integrally with the cap at the first end portion of the support member. The second end portion of the support member is positioned at the top panel. The support member defines a fuel supply passage that extends between the first and second end portions of the support member. A burner body is mounted to the cap such that the burner body is positioned above and spaced from the top panel. The burner body has a side wall that defines a plurality of flame ports. The flame ports of the plurality of flame ports are suppliable with fuel from the fuel supply passage of the support member.

In a second exemplary embodiment, a cooktop appliance is provided. The cooktop appliance includes a top panel and a plurality of gas burner assemblies. Each gas burner assembly of the plurality of gas burner assemblies includes a cap, a support member and a burner body. The support member extends between a first end portion and a second end portion. The support member is formed integrally with the cap at the first end portion of the support member. The second end portion of the support member is positioned at the top panel. The support member defines a fuel supply passage that extends between the first and second end portions of the support member. A burner body is mounted to the cap such that the burner body is positioned above and spaced from the top panel. The burner body has a side wall that defines a plurality of flame ports. The flame ports of the plurality of flame ports are suppliable with fuel from the fuel supply passage of the support member.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIGS. 9, 10 and 11 provide top, perspective views of the exemplary cooktop appliance of FIG. 1 with a dual grate and a griddle.

DETAILED DESCRIPTION

Figure 1:
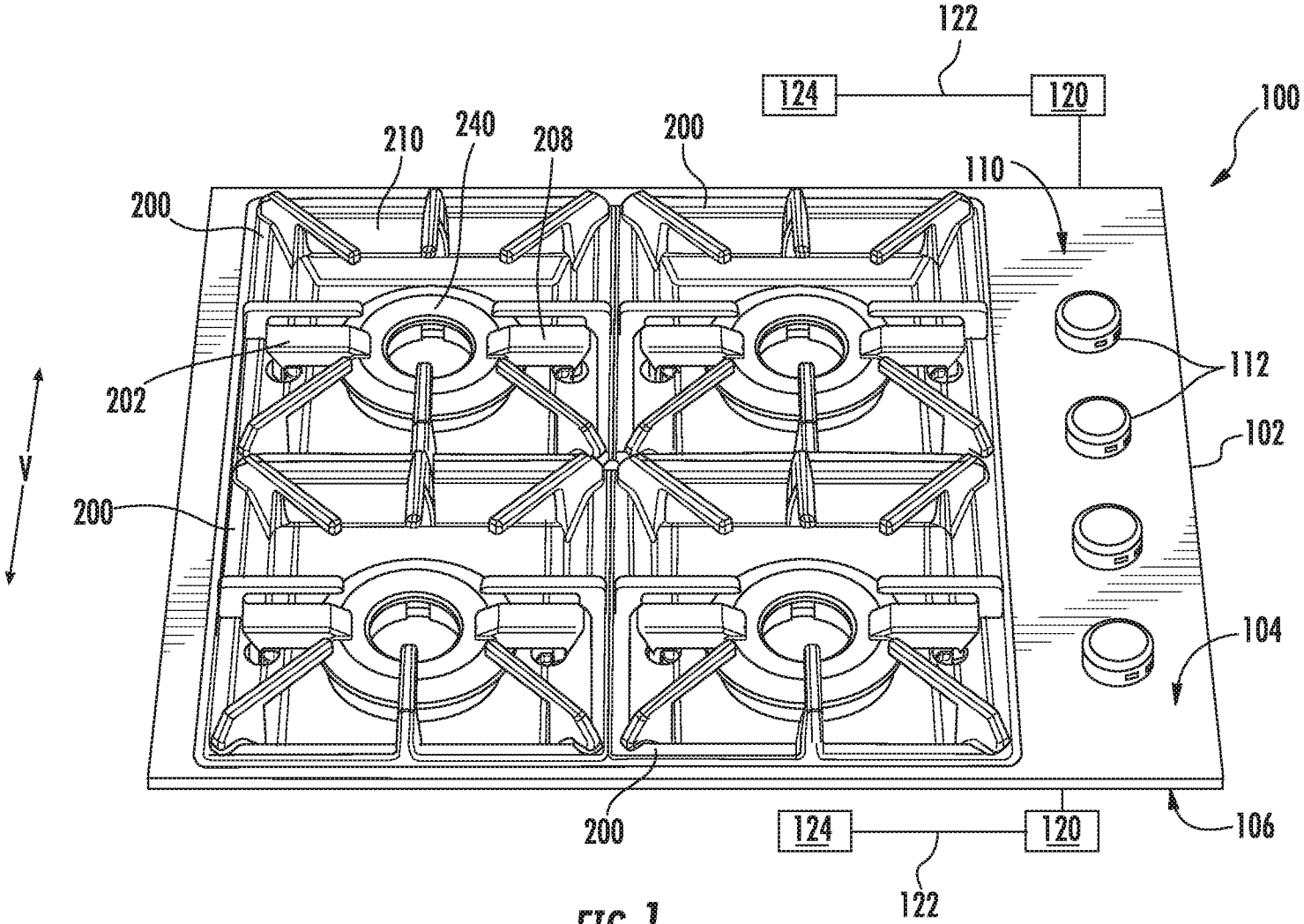
FIG. 1 provides a top, perspective view of a cooktop appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates an exemplary embodiment of a cooktop appliance 100 as may be employed with the present subject matter. Cooktop appliance 100 includes a panel 102, e.g., a top panel. By way of example, panel 102 may be constructed of enameled steel, stainless steel, glass, ceramics and combinations thereof.

For cooktop appliance 100, a utensil holding food and/or cooking liquids (e.g., oil, water, etc.) may be placed onto gas burner assemblies 200 at a location of any of gas burner assemblies 200. Gas burner assemblies 200 can be configured in various sizes so as to provide e.g., for the receipt of cooking utensils (i.e., pots, pans, etc.) of various sizes and configurations and to provide different heat inputs for such cooking utensils. Gas burner assemblies 200 are supported on a top surface 104 of panel 102, as discussed in greater detail below. Gas burner assemblies 200 provide thermal energy to cooking utensils above panel 102.

A user interface panel 110 is located within convenient reach of a user of the cooktop appliance 100. For this exemplary embodiment, user interface panel 110 includes knobs 112 that are each associated with one of gas burner assemblies 200. Knobs 112 allow the user to activate each burner assembly and determine the amount of heat input provided by each gas burner assemblies 200 to a cooking utensil located thereon. User interface panel 110 may also be provided with one or more graphical display devices that deliver certain information to the user such as e.g., whether a particular burner assembly is activated and/or the level at which the burner assembly is set.

Although shown with knobs 112, it should be understood that knobs 112 and the configuration of cooktop appliance 100 shown in FIG. 1 is provided by way of example only. More specifically, user interface panel 110 may include various input components, such as one or more of a variety of touch-type controls, electrical, mechanical or electromechanical input devices including rotary dials, push buttons, and touch pads. User interface panel 110 may include other display components, such as a digital or analog display device designed to provide operational feedback to a user.

Cooktop appliance 100 shown in FIG. 1 illustrates an exemplary embodiment of the present subject matter. Thus, although described in the context of cooktop appliance 100, the present subject matter may be used in cooktop appliances having other configurations, e.g., a cooktop appliance with one, two, or more additional burner assemblies. Similarly, the present subject matter may be used in cooktop appliances that include an oven, i.e., range appliances.

Figure 2:
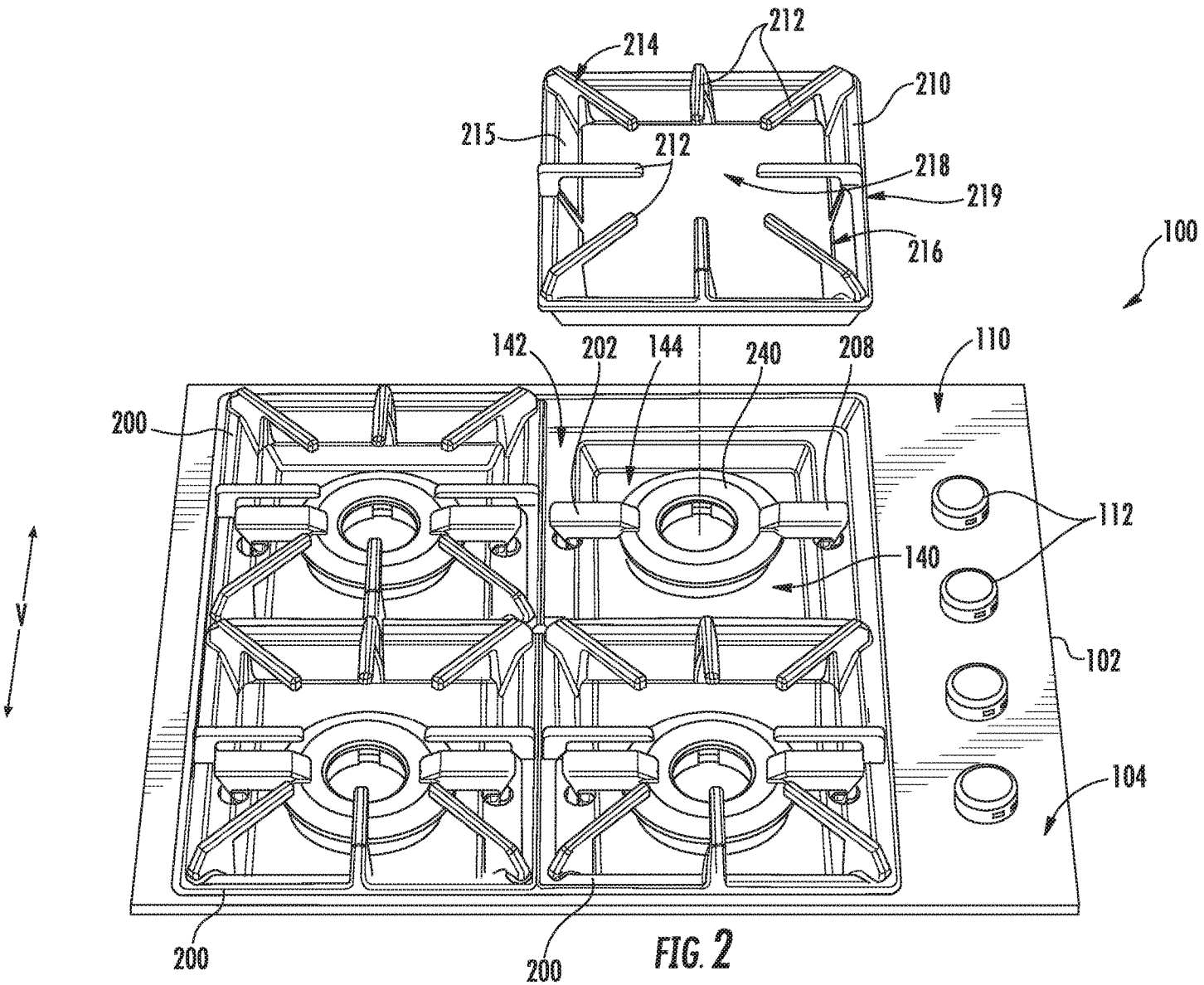
FIG. 2 provides another top, perspective view of the exemplary cooktop appliance of FIG. 1 with a grate of the exemplary cooktop appliance shown removed from a panel of the exemplary cooktop appliance.
Figure 3:
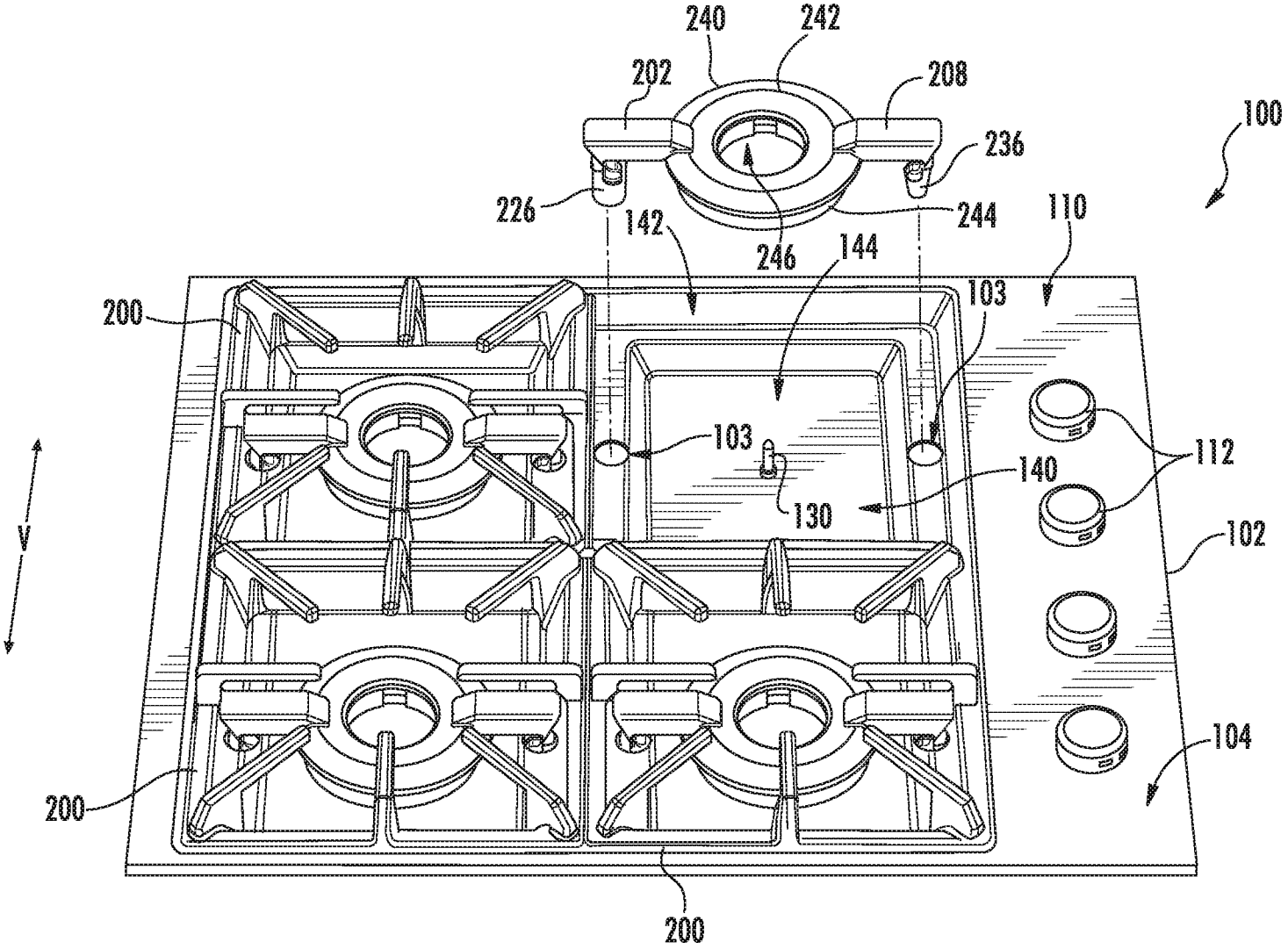
FIG. 3 provides another top, perspective view of the exemplary cooktop appliance of FIG. 1 with a gas burner assembly of the exemplary cooktop appliance shown removed from the panel of the exemplary cooktop appliance.

FIG. 2 provides another top, perspective view of cooktop appliance 100 with a grate 210 of cooktop appliance 100 shown removed from panel 102 of cooktop appliance 100. FIG. 3 provides another top, perspective view of cooktop appliance 100 with a gas burner assembly 200 of cooktop appliance 100 shown removed from panel 102 of cooktop appliance 100. As may be seen in FIGS. 2 and 3, gas burner assembly 200 and grate 210 are, e.g., separately, removable from panel 102 of cooktop appliance 100. In certain exemplary embodiments, no mechanical fastening connects gas burner assembly 200 and/or grate 210 to panel 102. Thus, grate 210 may not be fastened to panel 102, and a user may simply lift grate 210 upwardly away from gas burner assembly 200 to remove grate 210 from panel 102, as shown in FIG. 2. Similarly, gas burner assembly 200 may not be fastened to panel 102, and a user may simply lift gas burner assembly 200 upwardly to remove gas burner assembly 200 from panel 102, as shown in FIG. 3. In such a manner, top surface 104 of panel 102 below gas burner assembly 200 and grate 210 may be easily accessible and cleanable.

As shown schematically in FIG. 1, cooktop appliance 100 includes control valves 120, fuel lines 122 and fuel orifices 124. Control valves 120 may be mounted to panel 102 at a bottom surface 106 of panel 102. Fuel lines 122 and fuel orifices 124 may also be positioned below panel 120, e.g., at or adjacent bottom surface 106 of panel 102.

Panel 102 may also be formed with a recess or sump 140 below gas burner assemblies 200. Thus, top surface 104 of panel 102 may have a first (e.g., flat or planar) top surface portion 142 and a second (e.g., flat or planar) top surface portion 144. First top surface portion 142 may be positioned above second top surface portion 144, e.g., along a vertical direction V. Sump 140 may be configured for collecting liquid and other spills from cooking utensils on gas burner assemblies 200.

Control valves 120 are each coupled to a respective one of knobs 112. Thus, a user may adjust control valves 120 with knobs 112. Control valves 120 are configured for regulating fuel flow to gas burner assemblies 200. For example, control valves 120 block fuel flow to gas burner assemblies 200 when control valves 120 are closed. Conversely, control valves 120 permit fuel flow to gas burner assemblies 200 when control valves 120 are open. A user may selectively adjust control valves 120 between the open and closed configurations with knobs 112 in order to regulate fuel flow to gas burner assemblies 200.

Fuel lines 122 extend between control valves 120 and fuel orifices 124. Thus, control valves 120 and fuel orifices 124 may be coupled to fuel lines 122. When control valves 120 are open, fuel, such as propane or natural gas, may flow through fuel lines 122 to fuel orifices 124. From fuel orifices 124, the fuel may flow into gas burner assemblies 200 where the fuel may be combusted, as discussed in greater detail below.

Between fuel orifices 124 and gas burner assemblies 200, fuel from fuel orifices 124 may entrain and mix with air. Cooktop appliance 100 includes features for assisting mixing of air and fuel as the fuel enters gas burner assemblies 200. In particular, cooktop appliance 100 includes Venturi mixers 226 (FIG. 3) that receive the fuel and air and facilitate fluid mixing of the fuel and air. For example, Venturi mixers 226 may be tapered such that a pressure of the fuel and air decreases while a velocity of the fuel and air increases. Downstream of Venturi mixers 226, the pressure of the fuel and air may increase while the velocity of the fuel and air decreases to further assist fluid mixing between the fuel and air entering gas burner assemblies 200.

Figure 4:
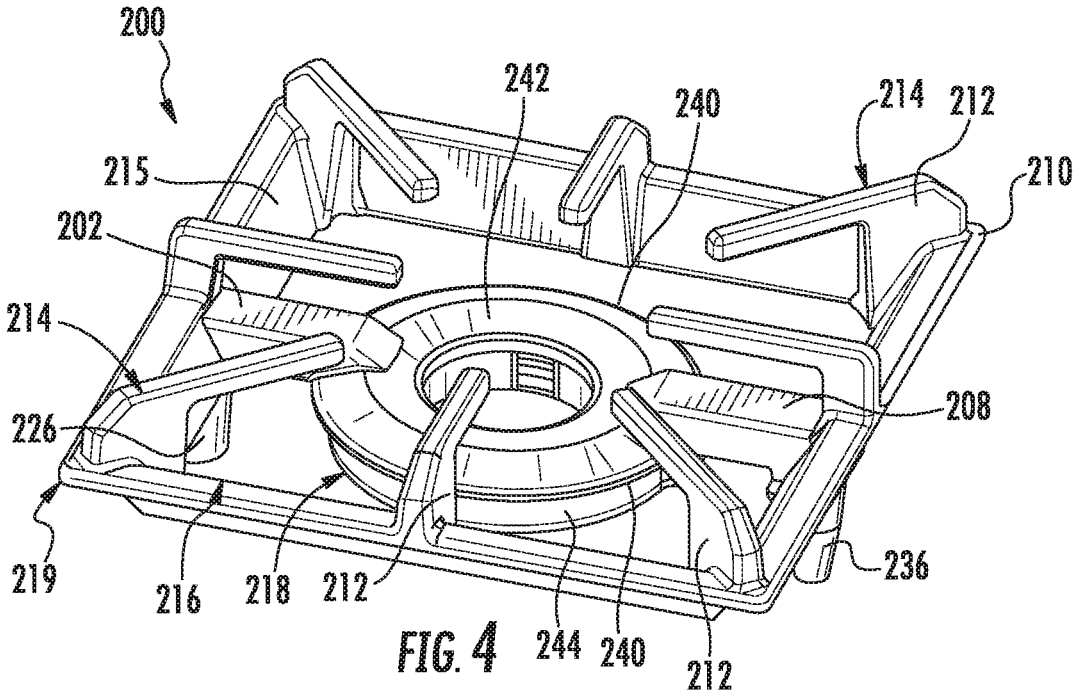
FIG. 4 provides a perspective view of the grate and the gas burner assembly of the exemplary cooktop appliance of FIG. 1.
Figure 5:
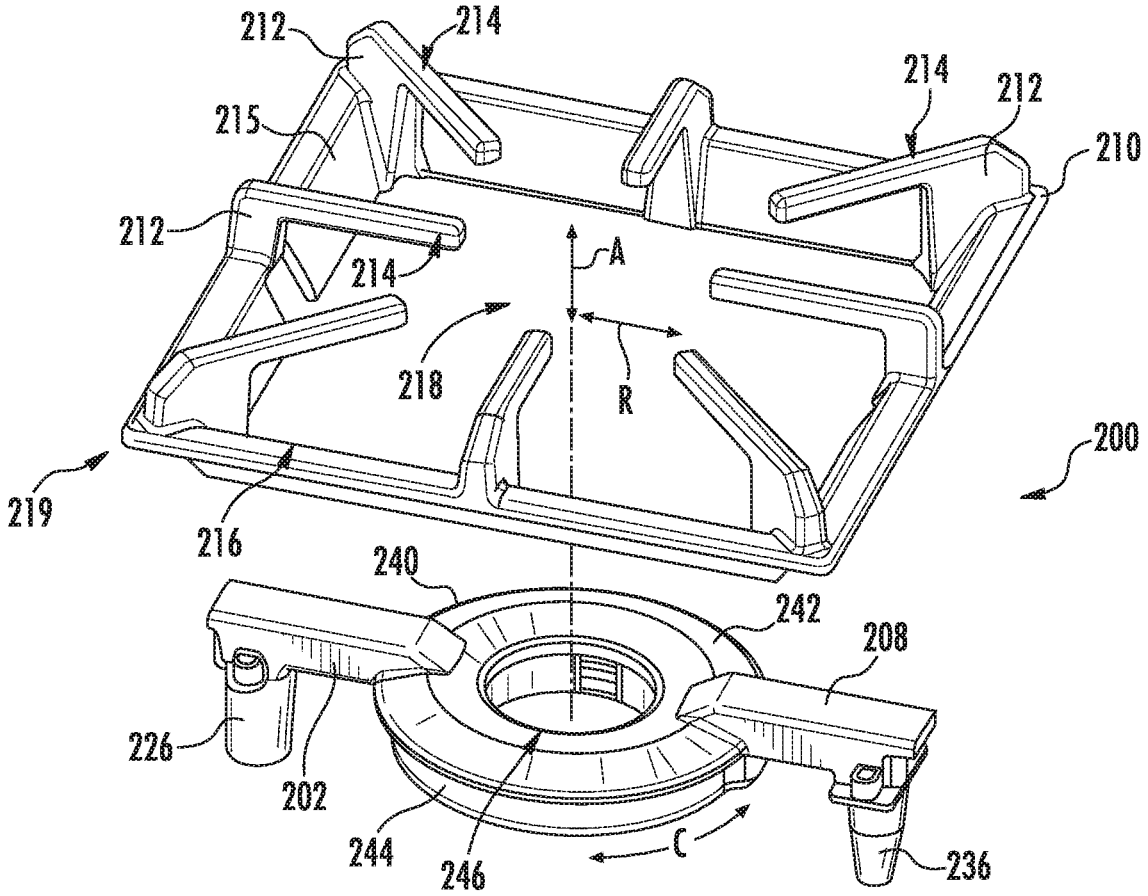
FIGS. 5 and 6 provide exploded, perspective views of the grate and the gas burner assembly of the exemplary cooktop appliance of FIG. 1.
Figure 6:
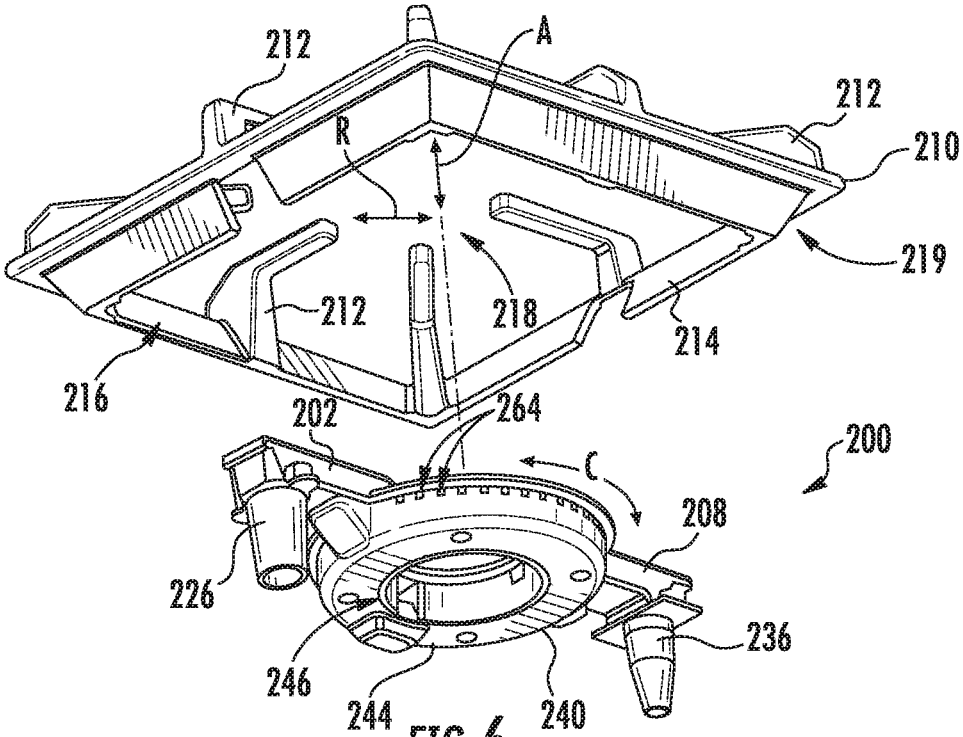

FIG. 4 provides a top, perspective view of one of gas burner assemblies 200 and grate 210. FIG. 5 provides a top, exploded view of one of gas burner assemblies 200 and grate 210. FIG. 6 provides a bottom, exploded view of one of gas burner assemblies 200 and grate 210. Various features of gas burner assembly 200 are discussed in greater detail below in the context of FIGS. 4 through 6.

As may be seen in FIGS. 4 through 6, gas burner assembly 200 is nested within grate 210. Grate 210 is configured for supporting a cooking utensil, such as a pot, pan, etc. For example, grate 210 includes a plurality of tines or elongated members 212, e.g., formed of cast metal, such as cast iron. The cooking utensil may be placed on the elongated members 212 of grate 210 such that the cooking utensil rests on an upper surface 214 of elongated members 212. Elongated members 212 of grate 210 may include a base or outer frame 215 that extends around or defines a perimeter of grate 210 and/or gas burner assembly 200. Thus, outer frame 215 may be positioned at an outer portion 219 of grate 210. Grate 210 may rest on panel 102 (e.g., first top surface portion 142) at outer frame 215 of grate 210. Thus, a bottom surface of outer frame 215 may rest on top surface 104 of panel 102. As shown in FIG. 5, outer frame 215 of grate 210 may be square or rectangular in certain exemplary embodiments. Within outer frame 215, elongated members 212 may define an inner passage 216 that extends vertically through grate 210. Thus, fluid, such as air, may flow through grate 210 via inner passage 216. To nest gas burner assembly 200 within grate 210, support members 202, 208 of gas burner assembly 200 may be received within notches defined by outer frame 215 of grate 210, and burner body 240 may be positioned under elongated members 212 of grate 210 at central portion 218 of grate 210.

Figure 7:
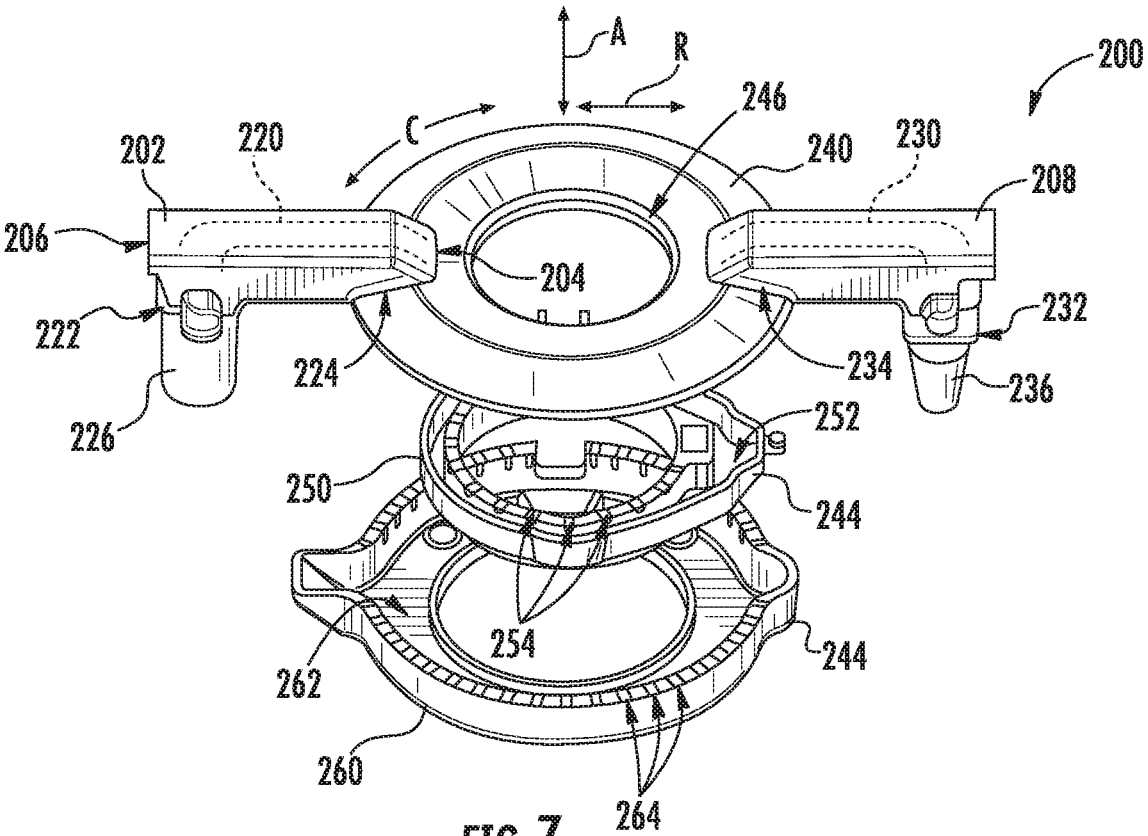
FIGS. 7 and 8 provide exploded, perspective views of the gas burner assembly of the exemplary cooktop appliance of FIG. 1.
Figure 8:
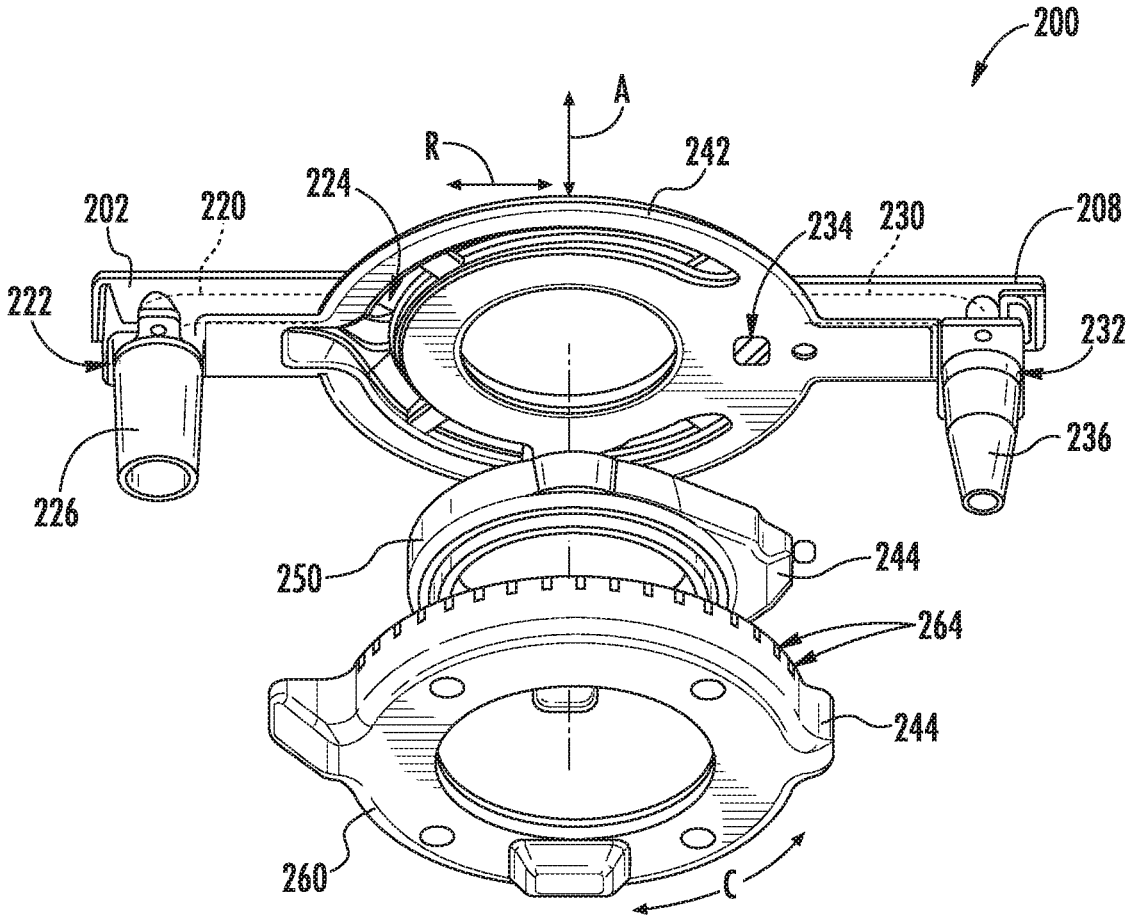

FIG. 7 provides a top, exploded view of gas burner assembly 200. FIG. 8 provides a bottom, exploded view of gas burner assembly 200. As may be seen in FIGS. 7 and 8, gas burner assembly 200 includes a first support member 202, a second support member 208 and a burner body 240. Burner body 240 is suspended by first and second support members 202, 208, e.g., such that burner body 240 is positioned at a central portion 218 of grate 210. Thus, burner body 240 may be positioned at or within inner passage 216 of grate 210, e.g., such that air within inner passage 216 of grate 210 flows by, around or through burner body 240. Elongated members 212 of grate 210 may be spaced from burner body 240, e.g., along the axial direction A, such that elongated members 212 of grate 210 do not contact burner body 240 at central portion 218 of grate 210.

Burner body 240 may include a cap 242 and a base 244. Cap 242 of burner body 240 may be mounted to first and second support members 202, 208. In particular, cap 242 may be integrally formed with first and second support members 202, 208, e.g., such that first and second support members 202, 208 and cap 242 of burner body 240 are formed of or with a common piece of material. For example, first and second support members 202, 208 and cap 242 of burner body 240 may be cast as a single, continuous piece of metal, such as cast iron or aluminum. Base 244 of burner body 240 is mounted to cap 242 of burner body 240, e.g., with fasteners, such that base 244 and cap 242 of burner body 240 form flame ports of burner body 240, as discussed in greater detail below. Thus, cap 242 of burner body 240 and base 244 of burner body 240 may be separate pieces of material, such as cast metal (e.g., brass, aluminum or iron), that are mounted to each other to form burner body 240.

Burner body 240 may be a multi-ring burner, in certain exemplary embodiments. Thus, burner body 240 includes an inner burner ring 250 and an outer burner ring 260. The inner and outer burner rings 250, 260 may be concentrically positioned, e.g., such that outer burner ring 260 extends around inner burner ring 250. Inner burner ring 250 has a fuel chamber 252 and a plurality of flame ports 254. Similarly, outer burner ring 260 has a fuel chamber 262 and a plurality of flame ports 264. Fuel chamber 252 of inner burner ring 250 may be separated from fuel chamber 262 of outer burner ring 260 within burner body 240, e.g., by a wall within burner body 240. As shown in FIG. 5, cap 242 of burner body 240 may define a passage 246 that allows air to flow through burner body 240 at inner burner ring 250. Fuel chamber 252 of inner burner ring 250 and/or fuel chamber 262 of outer burner ring 260 may extend circumferentially around passage 246 within base 244.

Turning back to FIGS. 6 and 7, first and second support members 202, 208 includes features for supplying fuel to burner body 240, e.g., to inner burner ring 250 and outer burner ring 260 of burner body 240. In particular, first support member 202 defines a first internal fuel passage 220, and second support member 208 defines a second internal fuel passage 230. First and second internal fuel passages 220, 230 are configured for directing fuel through first and second support member 202, 208 to burner body 240. In particular, first internal fuel passage 220 is contiguous with fuel chamber 252 of inner burner ring 250. Thus, fuel from first internal fuel passage 220 may flow into fuel chamber 252 of inner burner ring 250 and exit fuel chamber 252 of inner burner ring 250 at flame ports 254 of inner burner ring 250 where such fuel may be combusted. Similarly, second internal fuel passage 230 is contiguous with fuel chamber 262 of outer burner ring 260. Thus, fuel from second internal fuel passage 230 may flow into fuel chamber 262 of outer burner ring 260 and exit fuel chamber 262 of outer burner ring 260 at flame ports 264 of outer burner ring 260 where such fuel may be combusted.

By mounting burner body 240 to first and second support members 202, 208 and directing fuel through first and second support members 202, 208 to burner body 240, cleaning panel 102 below gas burner assembly 200 may be facilitated. For example, as shown in FIG. 3, burner body 240 may be mounted to first and second support members 202, 208 such that burner body 240 is suspended above or spaced apart from top surface 104 (e.g., second top surface portion 144) of panel 102, e.g., by a vertical gap. With burner body 240 separated from top surface 104 of panel 102, heat transfer between burner body 240 and panel 102 may be limited. Thus, panel 102 may be cooler during operation of gas burner assembly 200 relative to burners that contact panel 102, and burning of spilled or overflowed food particles on top surface 104 of panel 102 may be reduced or limited. In addition, with burner body 240 separated from top surface 104 of panel 102, access to panel 102 below burner body 240 may be easier than compared to burners that are positioned on and mounted to panel 102, and a user may more easily reach below burner body 240 to clean spills and overflows below burner body 240. Further, by supplying fuel through first and second support members 202, 208, burner body 240 need not receive fuel from directly below burner body 240 through panel 102. Thus, panel 102 may have no holes, less holes and/or smaller holes directly below burner body 240 relative to burners that are positioned on and mounted to panel 102 and receive fuel from directly below the burners. As shown in FIG. 3, an igniter 130 may be mounted to panel 102 below burner body 240, in certain exemplary embodiments.

Turning to FIGS. 6 and 7, first internal fuel passage 220 extends between an inlet 222 and an outlet 224. First support member 202 extends between a first end portion 204 and a second end portion 206. Inlet 222 of first internal fuel passage 220 is positioned at or adjacent a second end portion 206 of first support member 202. Conversely, outlet 224 of first internal fuel passage 220 is positioned at or adjacent first end portion 204 of first support member 202. Thus, first internal fuel passage 220 may extend between first and second end portions 204, 206 of first support member 202 within first support member 202. First Venturi mixer 226 is positioned at inlet 222 of first internal fuel passage 220. First Venturi mixer 226 may also extend through panel 102 through an opening 103 and be positioned above one of fuel orifices 124. Thus, fuel from one of fuel orifices 124 may pass through first Venturi mixer 226 and enter first internal fuel passage 220 at inlet 222 of first internal fuel passage 220. Outlet 224 of first internal fuel passage 220 is contiguous with fuel chamber 252 of inner burner ring 250. Thus, fuel from first internal fuel passage 220 may flow into burner body 240 via outlet 224 of first internal fuel passage 220.

Second internal fuel passage 230 may be formed within second support member 208 in a similar manner to that described above for first internal fuel passage 220 within first support member 202, e.g., such that second Venturi mixer 236 is positioned at inlet 232 of second internal fuel passage 230. Second Venturi mixer 236 may also be positioned above one of fuel orifices 124. Thus, fuel from one of fuel orifices 124 may pass through second Venturi mixer 236 and enter second internal fuel passage 230 at inlet 232 of second internal fuel passage 230. Outlet 234 of second internal fuel passage 230 is contiguous with fuel chamber 262 of outer burner ring 260. Thus, fuel from second internal fuel passage 230 may flow into burner body 240 via outlet 234 of second internal fuel passage 230.

As shown in FIGS. 6 and 7, first and second Venturi mixers 226, 236 may be positioned opposite each other on gas burner assembly 200. In particular, burner body 240 may be positioned between first and second Venturi mixers 226, 236. Thus, first and second internal fuel passages 220, 230 may also be positioned opposite each other on gas burner assembly 200, and burner body 240 may be positioned between first and second internal fuel passages 220, 230. In particular, outlet 224 of first internal fuel passage 220 may be positioned opposite outlet 234 of second internal fuel passage 230 on burner body 240. First and second Venturi mixers 226, 236 may also be integrally formed with first and second support members 202, 208 or may be separate components mounted, e.g., fastened, to first and second support members 202, 208.

Figure 9:
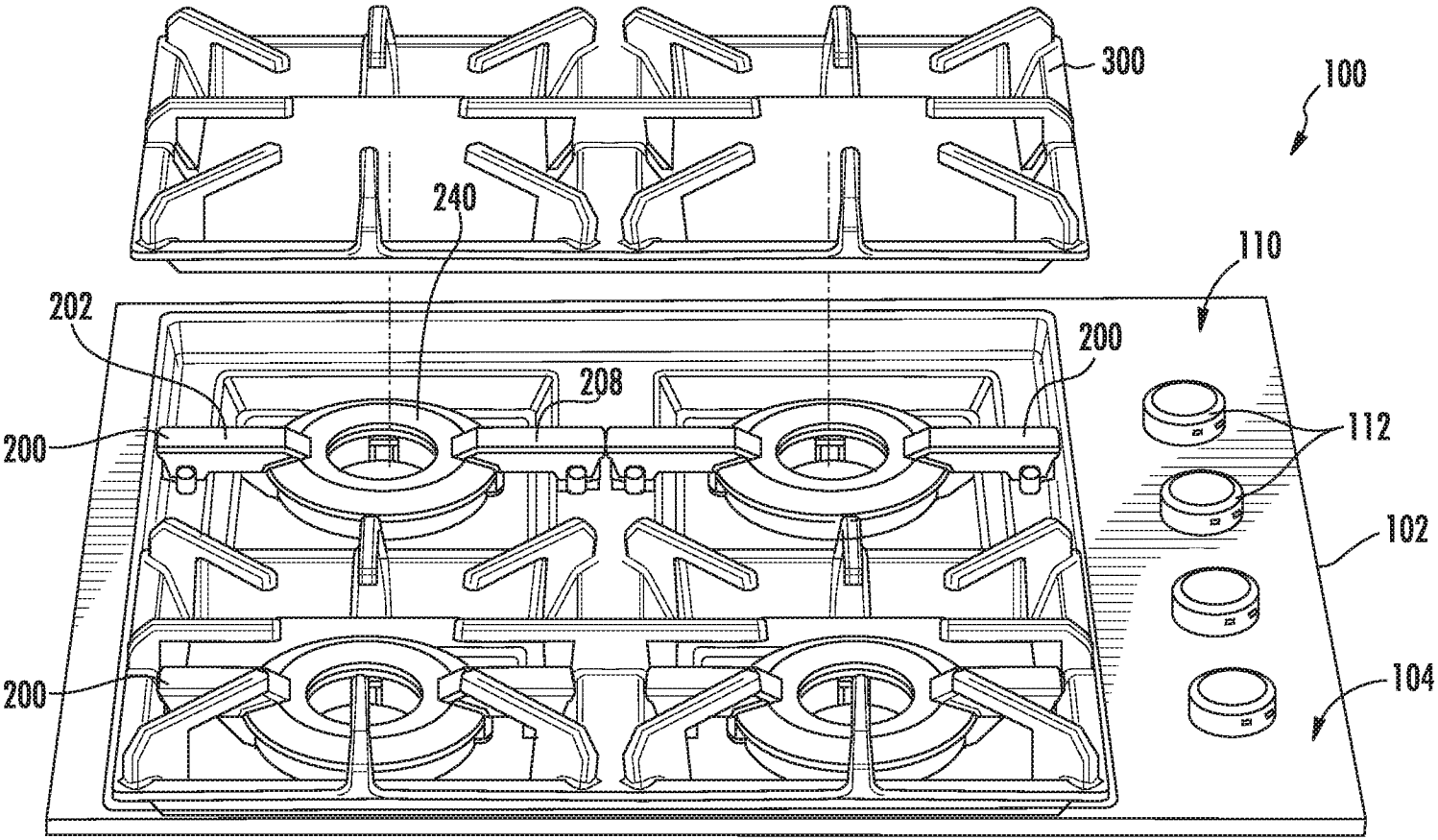
Figure 10:
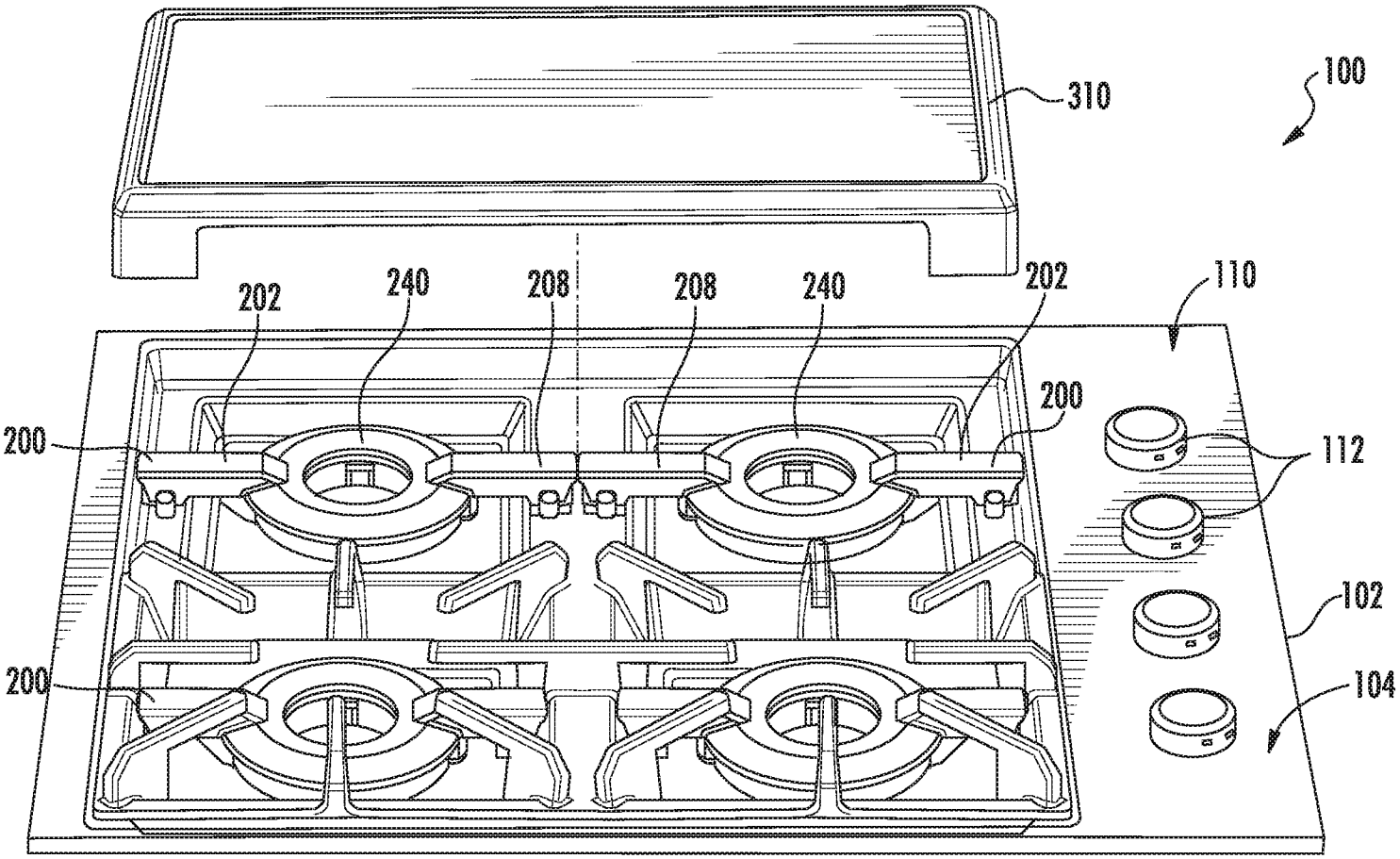
Figure 17:
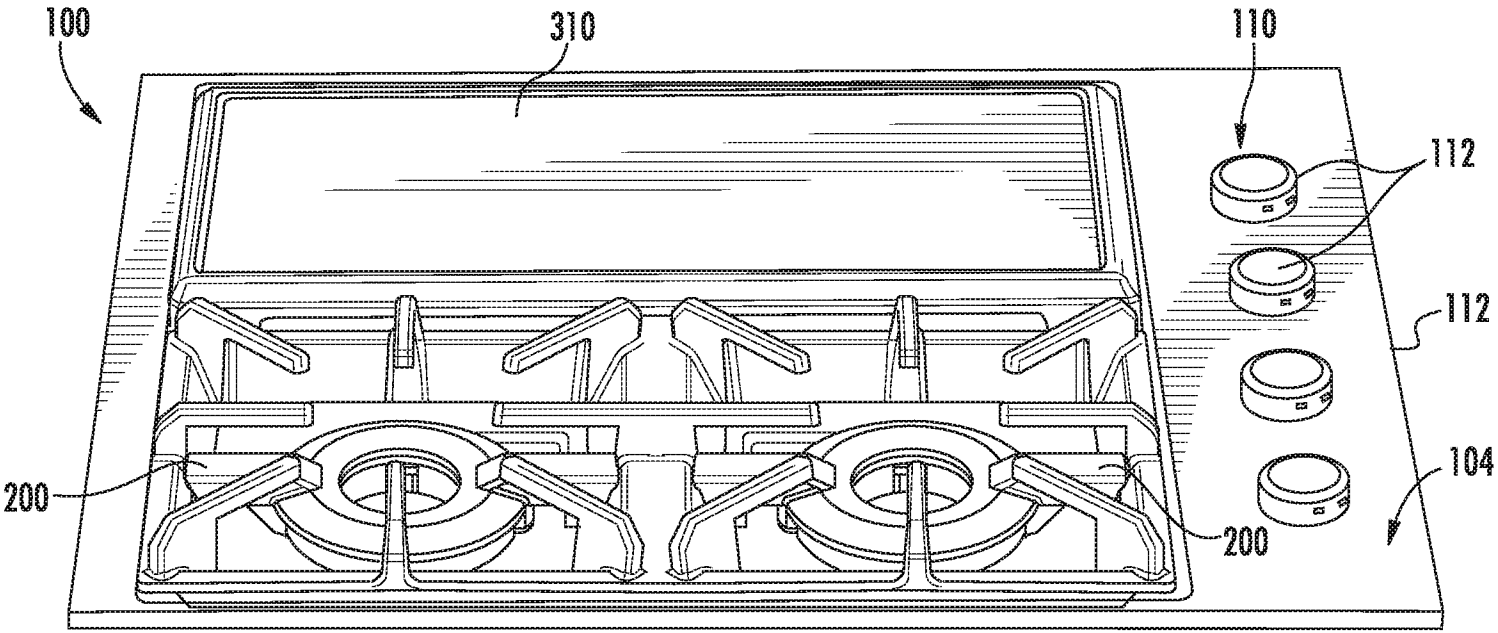

As shown in FIGS. 9 through 11, a grate 300 and a griddle 310 may each be nested over multiple gas burner assemblies 200. For example, grate 300 may be a double grate such that grate 300 is removable from two gas burner assemblies 200. In particular, the two gas burner assemblies 200 may remain on panel 102 when double grate 300 is removed from panel 102. With double grate 300 removed from panel 102, a griddle 310 may be positioned over the two gas burner assemblies 200. Thus, double grate 300 may be easily interchangeable with griddle 310 on panel 102 over the two gas burner assemblies 200.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance, comprising:

a top panel;

a gas burner assembly comprising a cap;

a support member extending between a first end portion and a second end portion, the support member formed integrally with the cap at the first end portion of the support member, the second end portion of the support member positioned at the top panel, the support member defining a fuel supply passage that extends between the first and second end portions of the support member, the fuel supply passage positioned internally within the support member; and a burner body mounted to the cap such that the burner body is positioned above and spaced from the top panel, the burner body having a side wall that defines a plurality of flame ports, the flame ports of the plurality of flame ports suppliable with fuel from the fuel supply passage of the support member, wherein the burner body is mounted to a bottom of the cap such that the burner body is suspended over the top panel on the support member.

2. The cooktop appliance of claim 1, wherein the top panel has a first top surface portion and a second top surface portion at a sump of the top panel, the first top surface portion of the top panel positioned above the second top surface portion of the top panel along a vertical direction, the first end portion of the support member positioned on the first top surface portion of the top panel, the burner body positioned above and spaced from the second top surface portion of the top panel.

3. The cooktop appliance of claim 1, wherein the gas burner assembly is slidably removable from the top panel.

4. The cooktop appliance of claim 1, further comprising a grate received over the gas burner assembly on the top panel, the grate removable from the gas burner assembly and the top panel.

5. The cooktop appliance of claim 4, wherein the grate comprises a base and a plurality of support tines, the base of the grate positioned on the top panel, the support tines of the plurality of support tines extending from the base towards the cap of the gas burner assembly, each distal end portion of the plurality of support tines positioned above and spaced from the cap of the gas burner assembly.

6. The cooktop appliance of claim 1, further comprising an igniter mounted to the top panel below of the gas burner assembly.

7. The cooktop appliance of claim 1, wherein the gas burner assembly further comprises a Venturi mixing tube mounted to the support member at the second end portion of the support member.

8. The cooktop appliance of claim 7, further comprising a fuel orifice positioned below the top panel at an entrance of the Venturi mixing tube.

9. The cooktop appliance of claim 7, wherein the top panel defines an opening, the Venturi mixing tube extending from the support member towards the fuel orifice through the opening of the top panel.

10. The cooktop appliance of claim 1, wherein the cap and the support member are integrally formed from cast iron, the burner body formed from brass or aluminum.

11. A cooktop appliance, comprising:

a top panel;

a plurality of gas burner assemblies, each gas burner assembly of the plurality of gas burner assemblies comprising a cap;

a support member extending between a first end portion and a second end portion, the support member formed integrally with the cap at the first end portion of the support member, the second end portion of the support member positioned at the top panel, the support member defining a fuel supply passage that extends between the first and second end portions of the support member, the fuel supply passage positioned internally within the support member; and a burner body mounted to the cap such that the burner body is positioned above and spaced from the top panel, the burner body having a side wall that defines a plurality of flame ports, the flame ports of the plurality of flame ports suppliable with fuel from the fuel supply passage of the support member, wherein the burner body is mounted to a bottom of the cap such that the burner body is suspended over the top panel on the support member.

12. The cooktop appliance of claim 11, wherein the top panel has a first top surface portion and a second top surface portion at a sump of the top panel, the first top surface portion of the top panel positioned above the second top surface portion of the top panel along a vertical direction, the burner body of each gas burner assembly positioned above and spaced from the second top surface portion of the top panel.

13. The cooktop appliance of claim 11, wherein the plurality of gas burner assemblies are slidably removable from the top panel.

14. The cooktop appliance of claim 11, further comprising a griddle and a grate, the griddle and the grate each receivable over at least two of the plurality of gas burner assemblies on the top panel such that the griddle and the grate are interchangeable on the top panel.

15. The cooktop appliance of claim 14, wherein the grate comprises a base and a plurality of support tines, the base of the grate positioned on the top panel, the support tines of the plurality of support tines extending from the base over the at least two of the plurality of gas burner assemblies.

16. The cooktop appliance of claim 11, further comprising a plurality of igniters, each igniter of the plurality of igniters mounted to the top panel below of a respective one of the gas burner assemblies.

17. The cooktop appliance of claim 11, wherein each gas burner assembly of the plurality of gas burner assemblies further comprises a Venturi mixing tube mounted to the support member at the second end portion of the support member.

18. The cooktop appliance of claim 17, further comprising a plurality of fuel orifices positioned below the top panel, each fuel orifice of the plurality of fuel orifices positioned at an entrance of a respective Venturi mixing tube of the plurality of gas burner assemblies.

19. The cooktop appliance of claim 18, wherein the top panel defines a plurality of openings, the respective Venturi mixing tube of the plurality of gas burner assemblies extending from through one of the plurality of openings.

20. The cooktop appliance of claim 11, wherein the cap and the support member of each gas burner assembly of the plurality of gas burner assemblies are integrally formed from cast iron, the burner body of each gas burner assembly of the plurality of gas burner assemblies is formed from brass or aluminum.

* * * * *